US010513405B2

(12) United States Patent
Kimura et al.

(10) Patent No.: US 10,513,405 B2
(45) Date of Patent: Dec. 24, 2019

(54) CONVEYOR DEVICE AND IMAGE RECORDING APPARATUS

(71) Applicant: BROTHER KOGYO KABUSHIKI KAISHA, Nagoya-shi, Aichi-ken (JP)

(72) Inventors: Aya Kimura, Yokohama (JP); Masao Mimoto, Nagoya (JP); Tsuyoshi Ito, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 15/938,025

(22) Filed: Mar. 28, 2018

(65) Prior Publication Data

US 2018/0282090 A1 Oct. 4, 2018

(30) Foreign Application Priority Data

Mar. 31, 2017 (JP) ..... 2017-069482

(51) Int. Cl.
*B65H 5/06* (2006.01)
*B65H 29/12* (2006.01)
(Continued)

(52) U.S. Cl.
CPC ..... *B65H 5/062* (2013.01); *B41J 11/14* (2013.01); *B65H 29/125* (2013.01); *B65H 29/14* (2013.01); *B65H 2301/4212* (2013.01); *B65H 2402/32* (2013.01); *B65H 2403/513* (2013.01); *B65H 2404/1115* (2013.01); *B65H 2404/144* (2013.01); *B65H 2404/152* (2013.01); *B65H 2404/1521* (2013.01); *B65H 2511/20* (2013.01); *B65H 2511/528* (2013.01);
(Continued)

(58) Field of Classification Search
CPC ..... B65H 5/062; B65H 2601/11; B65H 2404/144; B65H 29/125; B41J 11/006; G03G 21/1638
See application file for complete search history.

(56) References Cited

U.S. PATENT DOCUMENTS 7,346,294 B2 * 3/2008 Lee ..... G03G 15/6529 399/124
8,567,941 B2 * 10/2013 Sano ..... B41J 3/4071 347/101
(Continued)

FOREIGN PATENT DOCUMENTS

JP 2014-077942 A 5/2014

*Primary Examiner* — Luis A Gonzalez
(74) *Attorney, Agent, or Firm* — Merchant & Gould P.C.

(57) ABSTRACT

A conveyor device, including: a first roller; a second roller disposed under the first roller and configured to be movable between a nip position at which the second roller cooperates with the first roller to nip a sheet therebetween so as to discharge the sheet in a discharge direction and a separated position located at a height level lower than the nip position; a cover configured to be movable between a first position and a second position located at a height level lower than the first position, the cover including a downstream wall which at least partially covers a downstream portion of the second roller located at the nip position when the cover is located at the first position; and a moving mechanism configured to move the second roller between the nip position and the separated position and to move the cover between the first position and the second position.

14 Claims, 9 Drawing Sheets

(51) Int. Cl.
*B41J 11/14* (2006.01)
*B65H 29/14* (2006.01)

(52) U.S. Cl.
CPC .... *B65H 2601/11* (2013.01); *B65H 2601/321* (2013.01); *B65H 2801/15* (2013.01)

(56) References Cited

U.S. PATENT DOCUMENTS

| | | | | |
|---|---|---|---|---|
| 9,016,463 | B2 * | 4/2015 | Mimoto | B41J 3/4071 198/624 |
| 9,187,283 | B2 * | 11/2015 | Sano | B65H 29/125 |
| 9,517,645 | B2 * | 12/2016 | Iijima | B41J 3/60 |
| 9,694,606 | B2 * | 7/2017 | Ito | B41J 2/01 |
| 9,731,918 | B2 * | 8/2017 | Lee | B65H 1/266 |
| 9,783,381 | B2 * | 10/2017 | Kawamata | B65H 5/062 |
| 9,815,648 | B2 * | 11/2017 | Uchino | B65H 5/062 |
| 2011/0236118 | A1 * | 9/2011 | Ota | B41J 3/4071 400/642 |
| 2013/0293656 | A1 * | 11/2013 | Anami | B41J 11/006 347/104 |
| 2014/0103605 | A1 | 4/2014 | Yamada et al. | |

* cited by examiner

CONVEYOR DEVICE AND IMAGE RECORDING APPARATUS

CROSS REFERENCE TO RELATED APPLICATION

The present application claims priority from Japanese Patent Application No. 2017-069482, which was filed on Mar. 31, 2017, the disclosure of which is herein incorporated by reference in its entirety.

BACKGROUND

Technical Field

The following disclosure relates to a conveyor device configured to convey sheets and an image recording apparatus including the conveyor device.

Description of Related Art

There is known an image forming apparatus capable of preventing entry of foreign matters into an internal mechanism of the apparatus through a discharge opening of sheets. A sheet discharger of the image forming apparatus includes a discharge roller pair and a shield cover that covers the discharge roller pair.

SUMMARY

The sheet discharger of the known image forming apparatus includes the shield cover that covers the discharge roller pair. It is thus possible to prevent rollers of the discharge roller pair from being touched by a user or to prevent entry of foreign matters. In this configuration, however, when a user removes a sheet out of the sheet discharger in a jam clearing operation, it makes difficult for a user to perform the jam clearing operation.

Accordingly, one aspect of the present disclosure relates to a sheet conveyor device capable of preventing a jam clearing operation from becoming difficult to be performed even though the conveyor device is provided with a cover for a roller configured to convey a sheet. Another aspect of the present disclosure relates to an image recording apparatus including the sheet conveyor.

In one aspect of the present disclosure, a conveyor device includes: a first roller; a second roller disposed under the first roller and configured to be movable between a nip position at which the second roller cooperates with the first roller to nip a sheet therebetween so as to discharge the sheet in a discharge direction and a separated position located at a height level lower than the nip position; a cover configured to be movable between a first position and a second position located at a height level lower than the first position, the cover including a downstream wall which at least partially covers a downstream portion of the second roller located at the nip position when the cover is located at the first position; and a moving mechanism configured to move the second roller between the nip position and the separated position and to move the cover between the first position and the second position.

In another aspect of the present disclosure, an image recording apparatus includes: a conveyor device including a first roller, a second roller disposed under the first roller and configured to be movable between a nip position at which the second roller cooperates with the first roller to nip a sheet therebetween so as to discharge the sheet in a discharge direction and a separated position located at a height level lower than the nip position, a cover configured to be movable between a first position and a second position located at a height level lower than the first position, the cover including a downstream wall which at least partially covers a downstream portion of the second roller located at the nip position when the cover is located at the first position, and a moving mechanism configured to move the second roller between the nip position and the separated position and to move the cover between the first position and the second position; an image recorder disposed upstream of the second roller in the discharge direction; and a platen disposed below the image recorder, wherein the cover is formed integrally with the platen.

BRIEF DESCRIPTION OF THE DRAWINGS

The objects, features, advantages, and technical and industrial significance of the present disclosure will be better understood by reading the following detailed description of embodiments, when considered in connection with the accompanying drawings, in which.

DETAILED DESCRIPTION OF THE EMBODIMENTS

Figure 1:
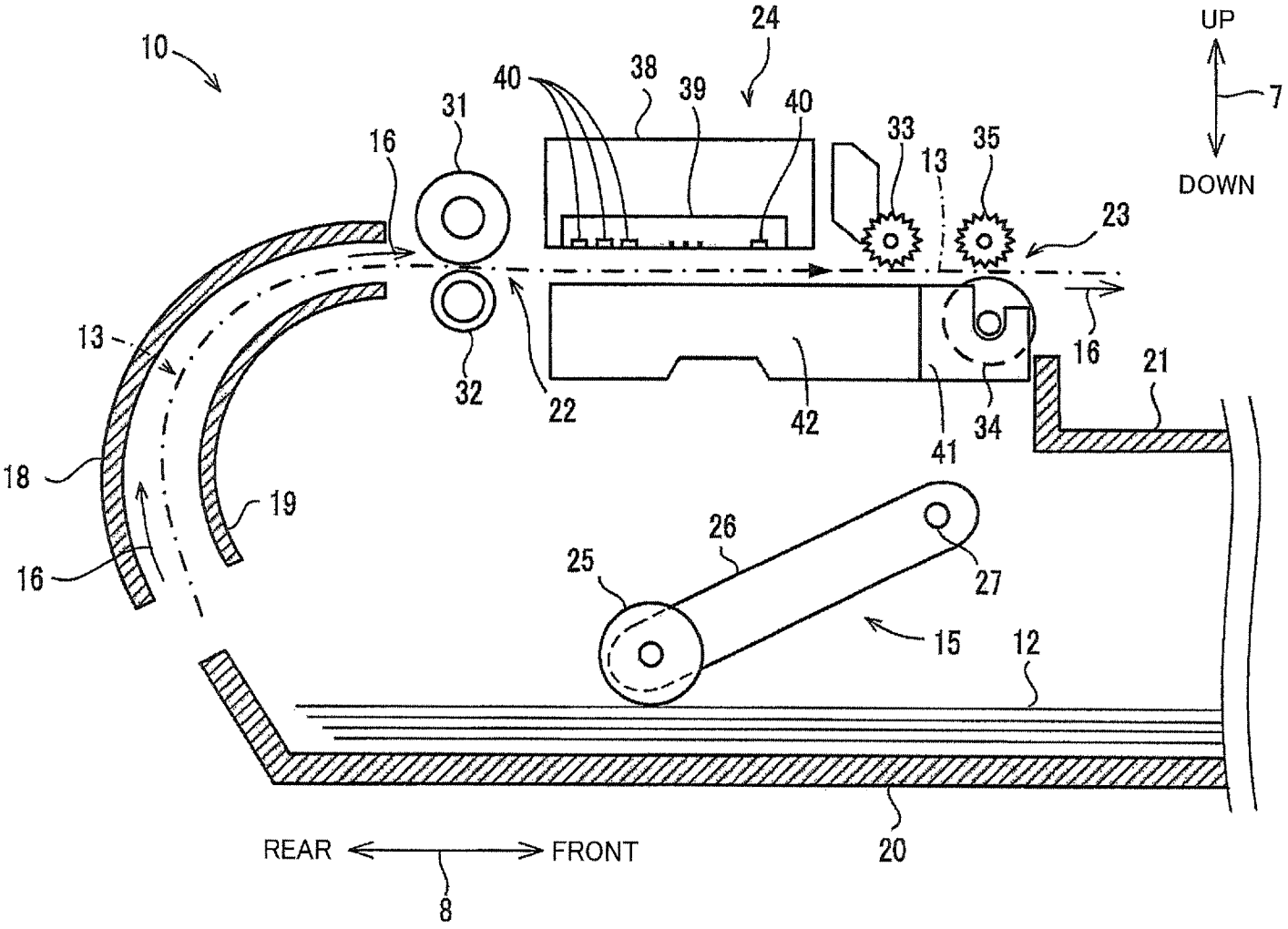
FIG. 1 is an elevational view in vertical cross section schematically showing an internal structure of a printer according to the embodiments.

There will be hereinafter explained embodiments of the present disclosure. It is to be understood the following embodiments are described only by way of example, and the present disclosure may be otherwise embodied without departing from the scope of the disclosure. An up-down direction 7 is defined with respect to an attitude of a printer 10 placed horizontally in its operative position as shown in FIG. 1. (The attitude of the printer 10 shown in FIG. 1 may be referred to as "operative attitude" where appropriate.) A front-rear direction 8 is defined regarding a surface of the printer 10 on which a discharge tray 21 is provided as a front surface, and a right-left direction 9 is defined in a state in which the printer 10 is viewed from the front surface. In the operative attitude of the printer 10, the up-down direction 7 corresponds to a vertical direction, and the front-rear direction 8 and the right-left direction 9 correspond to a horizontal direction.

First Embodiment

Referring first to FIGS. 1-8, the printer 10 (as one example of "conveyor device" and "image recording apparatus") according to a first embodiment will be explained.

Overall Structure of Printer 10

As shown in FIG. 1, the printer 10 is an ink-jet recording apparatus configured to record an image on a sheet 12. The printer 10 includes a sheet supplier 15, a supply tray 20, the discharge tray 21, a first conveyor 22, a second conveyor 23, an image recorder 24, and a platen 42. The printer 10 may have various other functions such as a facsimile function and a scanning function, in addition to the printing function.

Supply Tray 20 and Discharge Tray 21

The supply tray 20 is disposed at a lower portion of the printer 10. The supply tray 20 is insertable and removable in the front-rear direction 8. The supply tray 20 can support a stack of a plurality of sheets 12. The discharge tray 21 is located above the supply tray 20. The discharge tray 21 is configured to support the sheet 12 discharged from between the image recorder 24 and the platen 42 by the second conveyor 23.

Sheet Supplier 15

As shown in FIG. 1, the sheet supplier 15 includes a supply roller 25, a supply arm 26, and a shaft 27. The sheet supplier 15 is configured to supply, to a conveyance path 13, the sheet 12 supported on the supply tray 20. The supply roller 25 is rotatably supported by a distal end portion of the supply arm 26. The supply roller 25 is driven by a supply motor (not shown) so as to rotate forwardly. The supply arm 26 is pivotably supported by the shaft 27 which is supported by a frame of the printer 10. The supply arm 26 is biased by its own weight or an elastic force of a spring or the like, so as to be pivoted toward the supply tray 20.

The forward rotation of the supply roller 25 means that the supply roller 25 rotates in a direction to convey the sheet 12 in a discharge direction 16. Hereinafter, forward rotation of rollers other than the supply roller 25 also means that each roller rotates in a direction to convey the sheet 12 in the discharge direction 16.

Conveyance Path 13

As shown in FIG. 1, the conveyance path 13 extends upward from a rear end portion of the supply tray 20, makes a U-turn toward the front side, and reaches the discharge tray 21 via a space between the image recorder 24 and the platen 42. The printer 10 includes an outer guide 18 and an inner guide 19 which are opposed to each other with a space interposed therebetween. An inner space defined by the outer guide 18 and the inner guide 19 defines a U-turned portion of the conveyance path 13. A portion of the conveyance path 13 between the first conveyor 22 and the second conveyor 23 is located at a generally middle portion of the printer 10 in the right-left direction 9 and extends in the front-rear direction 8. The discharge direction 16 of the sheet 12 is indicated by arrows in FIG. 1 provided along the conveyance path 13.

First Conveyor 22 and Second Conveyor 23

As shown in FIG. 1, the first conveyor 22 is disposed upstream of the image recorder 24 in the discharge direction 16. The first conveyor 22 includes a conveyance roller 31 and a pinch roller 32 which are opposed to each other. The pinch roller 32 is located at a height level higher than the conveyance roller 31. The sheet 12 is conveyed while being nipped by the conveyance roller 31 and the pinch roller 32. The conveyance roller 31 is driven by a conveyance motor (not shown). The pinch roller 32 is rotated by rotation of the conveyance roller 31. The nipped sheet 12 is conveyed in the discharge direction 16 by the conveyance roller 31 which is rotated forwardly by forward rotation of the conveyance motor and the pinch roller 32.

The second conveyor 23 is disposed downstream of the image recorder 24 in the discharge direction 16. The second conveyor 23 includes first spurs 33, discharge rollers 34 (each as one example of "second roller"), and second spurs 35 (each as one example of "first roller"). The discharge rollers 34 and the second spurs 35 are disposed downstream of the first spurs 33 in the discharge direction 16 and are opposed to each other. The first spurs 33 are for preventing the sheet 12 from coming into contact with a recording head 39 when the sheet 12 floats up. The second spurs 35 are located at a height level higher than the discharge rollers 34. The sheet 12 is nipped by the discharge rollers 34 and the second spurs 35. The discharge rollers 34 are fixed to a rotation shaft 36 which is disposed coaxially with the discharge rollers 34. When the conveyance motor rotates the rotation shaft 36, the discharge rollers 34 are driven. The first spurs 33 are rotated by the sheet 12 that is being conveyed. The second spurs 35 are rotated by rotation of the corresponding discharge rollers 34. The nipped sheet 12 is conveyed in the discharge direction 16 by the discharge rollers 34 which are rotated forwardly by forward rotation of the conveyance motor and the second spurs 35.

Image Recorder 24

As shown in FIG. 1, the image recorder 24 is disposed between the first conveyor 22 and the second conveyor 23 in the discharge direction 16. The image recorder 24 includes a carriage 38 and the recording head 39.

The recording head 39 is mounted on the carriage 38. A plurality of nozzles 40 are formed in a lower surface of the recording head 39. A distal end of each nozzle 40 is exposed from the lower surface of the recording head 39. The entirety of the plurality of nozzles 40 is located downstream of the conveyance roller 31 and the pinch roller 32 in the discharge direction 16. The recording head 39 ejects, from the nozzles 40, ink as minute ink droplets. During a movement of the carriage 38 in the right-left direction 9, the recording head 39 ejects ink droplets to the sheet 12 supported on the platen 42. Thus, an image is recorded on the sheet 12.

Platen 42

As shown in FIG. 1, the platen 42 is disposed between the conveyance roller 31 and the discharge rollers 34 in the discharge direction 16. The image recorder 24 and the platen 42 are disposed so as to be opposed to each other in the up-down direction 7 with the conveyance path 13 interposed therebetween. The image recorder 24 is located at a height level higher than the platen 42. The platen 42 defines a lower surface of the conveyance path 13 below the image recorder 24.

Figure 2:
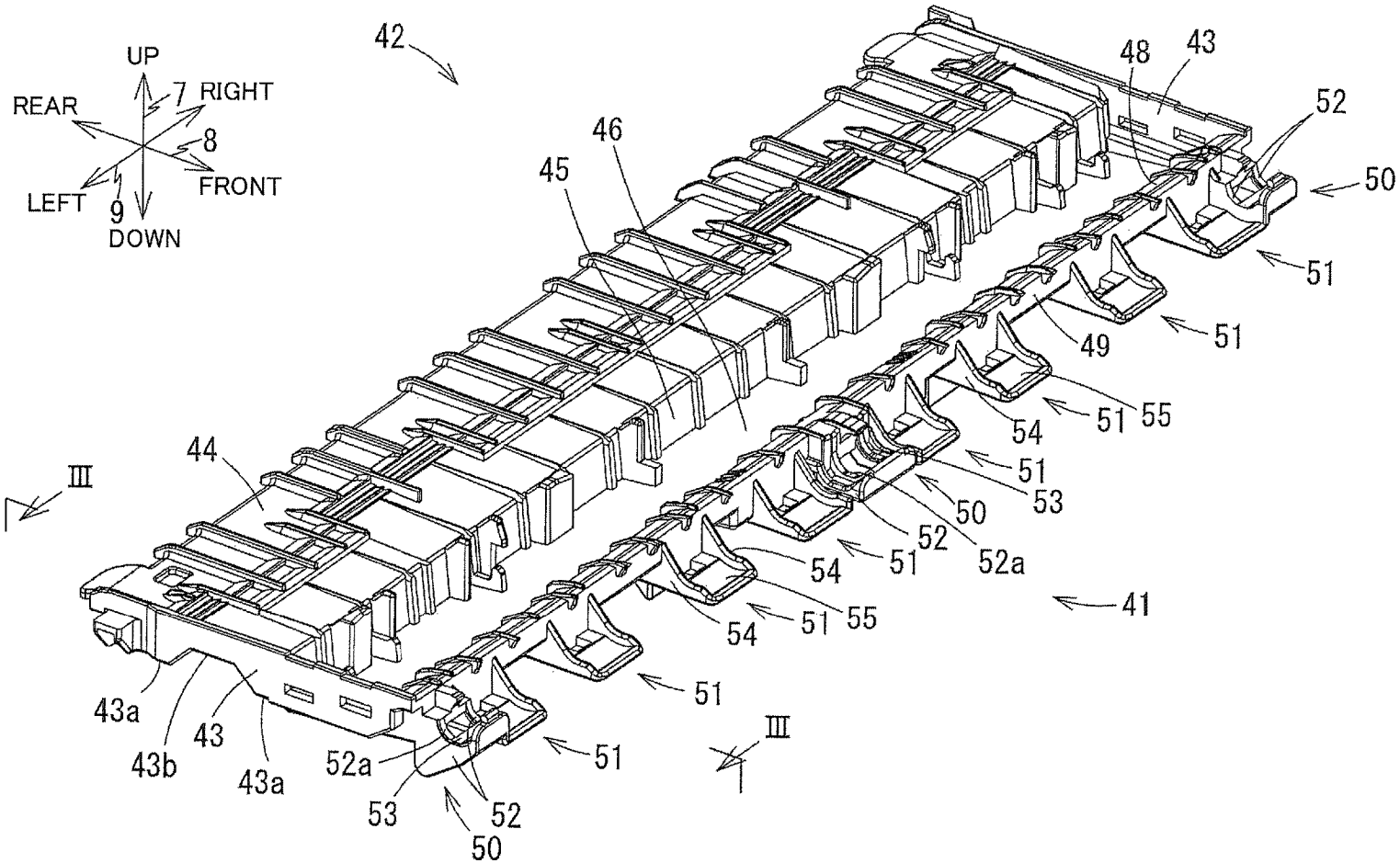
FIG. 2 is a perspective view of a platen and a cover according to a first embodiment viewed from a front left side.
Figure 3:
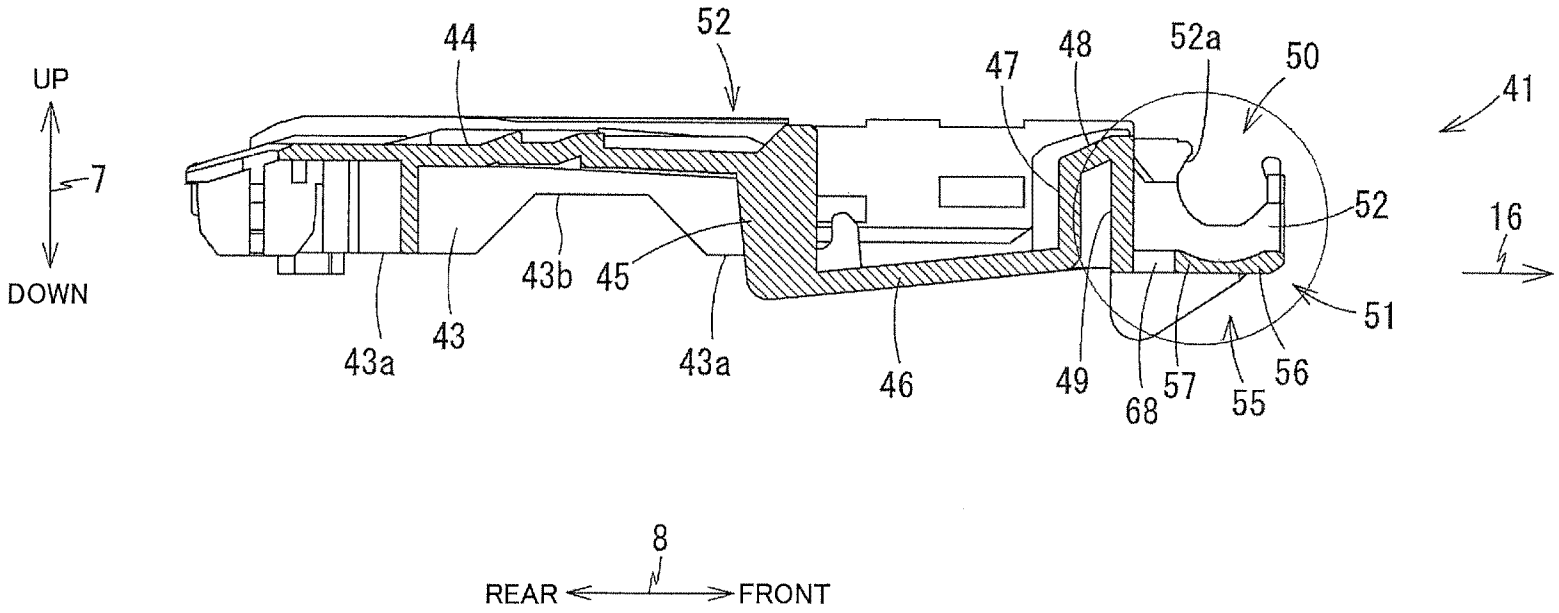
FIG. 3 is a cross-sectional view viewed along arrows of FIG. 2.

As shown in FIGS. 2 and 3, the platen 42 includes two side walls 43, a rear upper wall 44, a rear wall 45, a bottom wall 46, an intermediate wall 47, a front upper wall 48, and a front wall 49.

The two side walls 43 are respectively located at opposite end portions of the platen 42 in the right-left direction 9.

Each side wall 43 is a plate-like portion perpendicular to the right-left direction 9 and is long in the front-rear direction 8. A lower surface of the side wall 43 has flat portions 43*a* and a recessed portion 43*b* opening downward. The flat portions 43*a* are respectively located on a front side and a rear side of the recessed portion 43*b*.

Each of the rear upper wall 44, the rear wall 45, the bottom wall 46, the intermediate wall 47, the front upper wall 48, and the front wall 49 connects the two side walls 43 in the right-left direction 9. The rear upper wall 44 is a plate-like portion perpendicular to the up-down direction 7 and extends frontward from rear upper ends of the side walls 43. The rear wall 45 is a plate-like portion perpendicular to the front-rear direction 8 and extends downward from a front upper end of the rear upper wall 44. The bottom wall 46 is a plate-like portion perpendicular to the up-down direction 7 and extends frontward from a lower end of the rear wall 45. The intermediate wall 47 is a plate-like portion perpendicular to the front-rear direction 8 and extends upward from a front end of the bottom wall 46. The front upper wall 48 is a plate-like portion perpendicular to the up-down direction 7 and extends frontward from an upper end of the intermediate wall 47. The front wall 49 is a plate-like portion perpendicular to the front-rear direction 8 and extends downward from a front end of the front upper wall 48.

Cover 41

As shown in FIG. 1, the printer 10 includes a cover 41 which is disposed downstream of the platen 42 in the discharge direction 16 and which partially covers the discharge rollers 34. A posture of the cover 41 which will be hereinafter explained referring to FIGS. 2-7 is based on a case shown in FIG. 8A, namely, in a case where the discharge rollers 34 are located at a nip position PE1.

As shown in FIGS. 2 and 3, the cover 41 includes three engaging portions 50 and eight cover bodies 51. In the present embodiment, the cover 41 is formed integrally with the platen 42, and the three engaging portions 50 and the eight cover bodies 51 protrude frontward from the front wall 49 of the platen 42. The three engaging portions 50 and the eight cover bodies 51 are fixed to the front wall 49. Accordingly, the eight cover bodies 51 are fixed with respect to the three engaging portions 50.

As shown in FIGS. 2 and 3, the three engaging portions 50 are disposed at a central portion and opposite end portions of the front wall 49 in the right-left direction 9. The eight cover bodies 51 are arranged in the right-left direction 9. Four of the eight cover bodies 51 are disposed between the engaging portion 50 located at the left end portion of the front wall 49 and the engaging portion 50 located at the central portion, and four of the eight cover bodies 51 are disposed between the engaging portion 50 located at the right end portion of the front wall 49 and the engaging portion 50 located at the central portion of the front wall 49.

Figure 5:
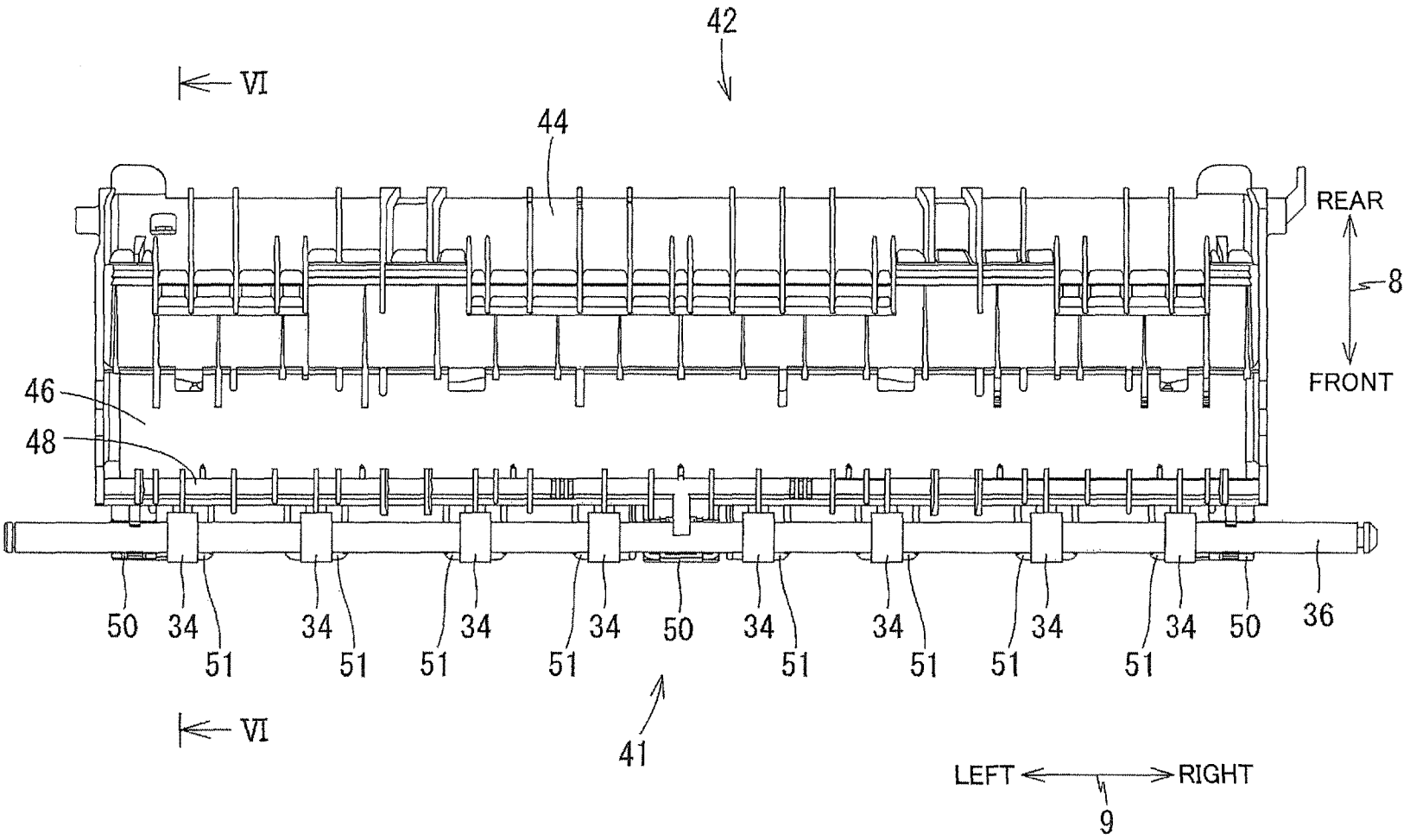
FIG. 5 is a plan view of the platen and the cover according to the first embodiment.

As shown in FIG. 5, the three engaging portions 50 support the rotation shaft 36 of the discharge rollers 34. The eight cover bodies 51 are located at positions in the right-left direction 9 corresponding to the respective discharge rollers 34, namely, the eight cover bodies 51 are located immediately under the corresponding discharge rollers 34. For the sake of convenience, the following explanation will be made focusing on one discharge roller 34 where appropriate.

Engaging Portion 50

Figure 4:
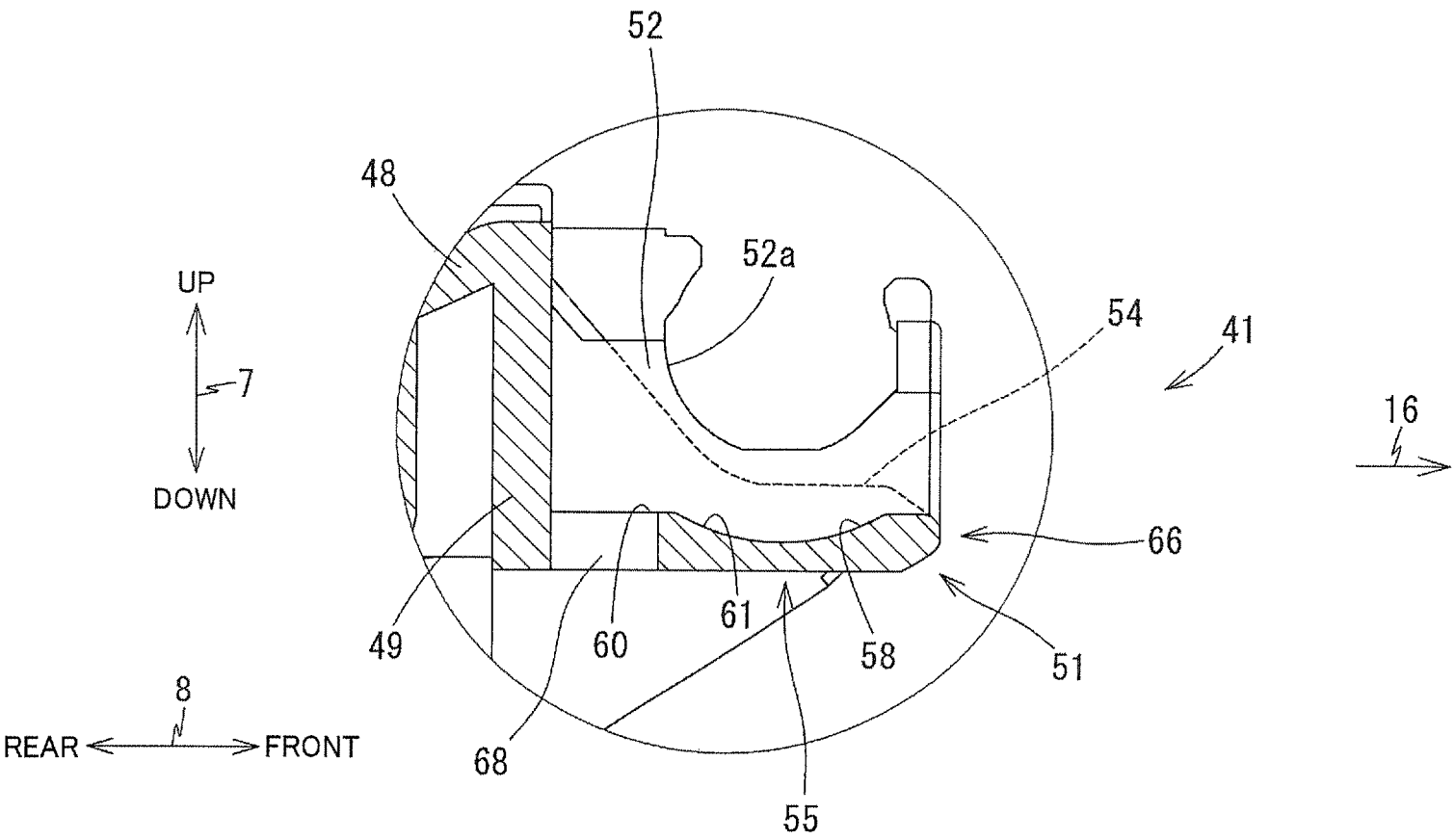
FIG. 4 is an enlarged view of a principal portion in FIG. 3.

As shown in FIGS. 2 and 3, each engaging portion 50 includes two side walls 52 and a connecting wall 53. The two side walls 52 are arranged in the right-left direction 9. Each side wall 52 is a plate-like portion perpendicular to the right-left direction 9. The connecting wall 53 is a plate-like portion perpendicular to the up-down direction 7. The connecting wall 53 connects the two side walls 52 in the right-left direction 9. The side wall 52 has a recessed portion 52*a* opening upward. The rotation shaft 36 of the discharge rollers 34 is engageable with the recessed portion 52*a*. As shown in FIGS. 3 and 4, an upper open end of the recessed portion 52*a* is slightly narrowed as seen in the right-left direction 9. Consequently, the rotation shaft 36 which is engaged with the recessed portion 52*a* does not easily come out of the engaging portion 50.

Cover Body 51

As shown in FIGS. 2-4, the cover body 51 includes two side walls 54 and a bottom wall 55 (as one example of "downstream wall" and "lower wall"). The two side walls 54 are arranged in the right-left direction 9. Each side wall 54 is a plate-like portion perpendicular to the right-left direction 9. The bottom wall 55 is a plate-like portion perpendicular to the up-down direction 7 and connects lower end portions of the side walls 54 in the right-left direction 9.

Figure 6:
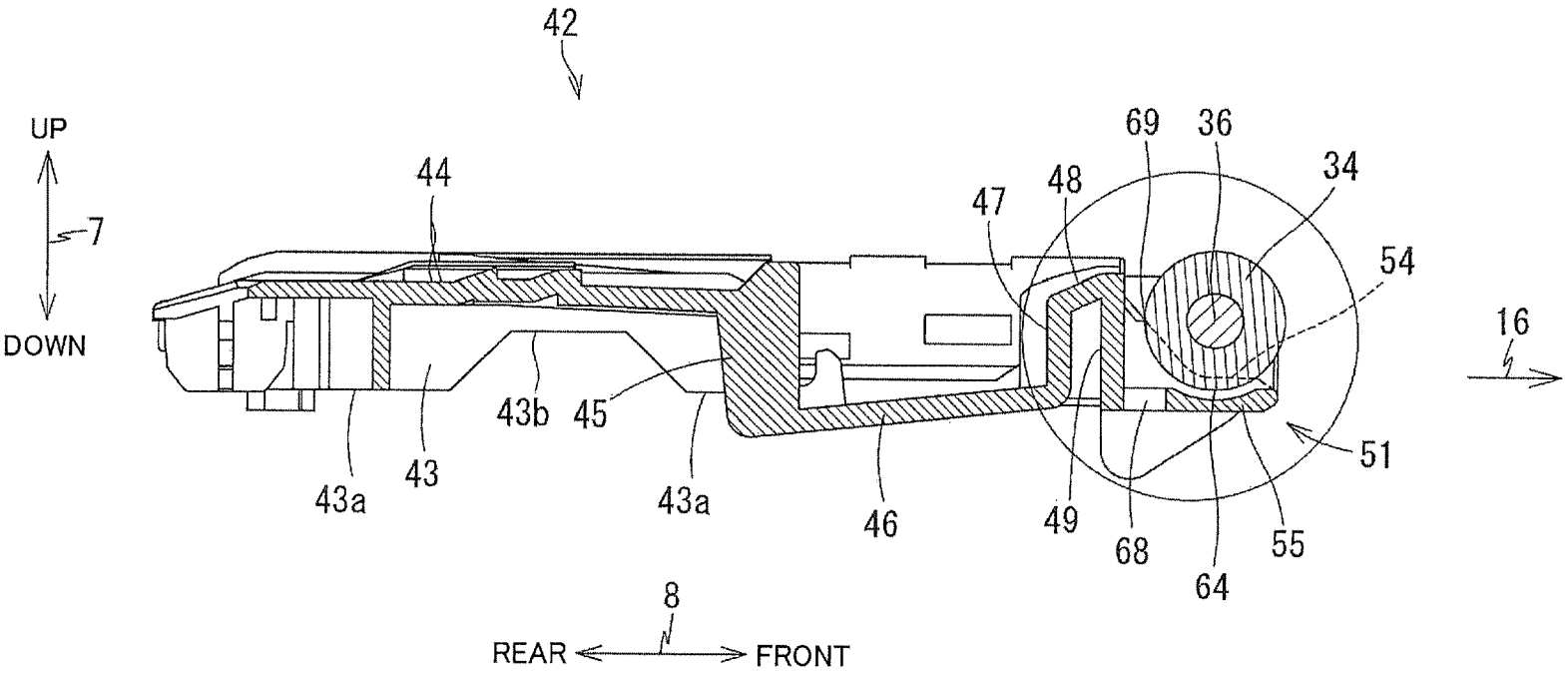
FIG. 6 is a cross-sectional view viewed along arrows VI-VI in FIG. 5.

As shown in FIGS. 2 and 6, an upper surface of the side wall 54 extends from an upper portion of the front wall 49 in a frontward-and-downward direction and then extends frontward. As shown in FIG. 6, the side walls 54 of the cover body 51 face respective end faces of the corresponding discharge roller 34 in the right-left direction 9. When viewed in the right-left direction 9, an upper portion of the side wall 54 overlaps a part of the discharge roller 34 along an outer circumferential portion of the discharge roller 34 ranging from a rear end 69 of the discharge roller 34 to a lower end 64 thereof. Thus, the side wall 54 covers a part of the end face of the discharge roller 34.

Figure 7:
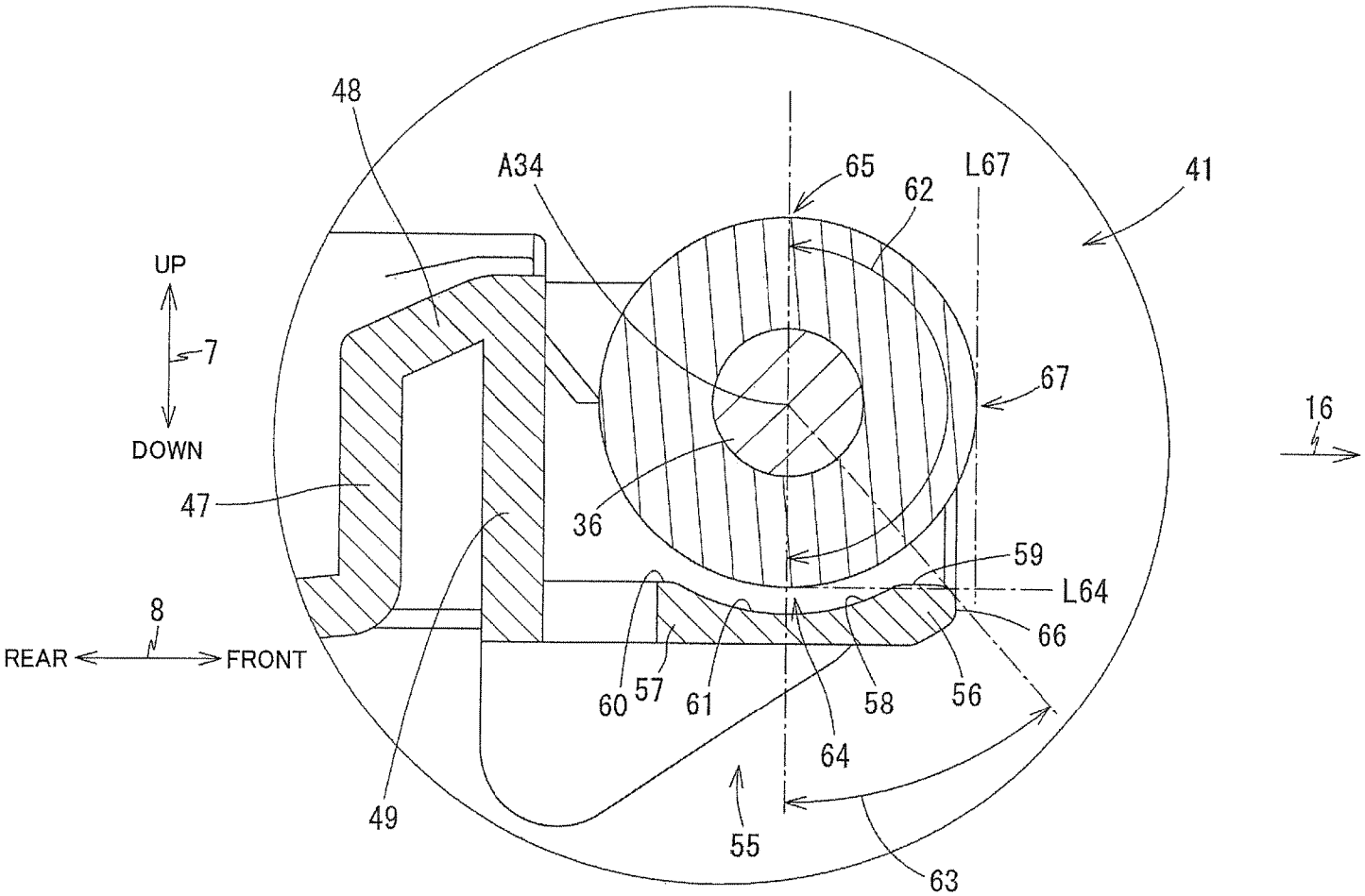
FIG. 7 is an enlarged view of a principal portion in FIG. 6.

As shown in FIGS. 4 and 7, the bottom wall 55 includes a front portion 56 and a rear portion 57 arranged in the front-rear direction 8. The front portion 56 (as one example of "downstream wall") is a portion located more frontward than an axis A34 of the discharge roller 34. The rear portion 57 is a portion located more rearward than the axis A34 of the discharge roller 34. An upper surface of the front portion 56 includes a curved surface 58 and a flat surface 59 which extends frontward from the curved surface 58 and which is perpendicular to the up-down direction 7. The curved surface 58 is a part of a cylindrical surface that extends along a circumferential direction of the axis A34 of the discharge roller 34. An upper surface of the rear portion 57 includes a flat surface 60 which is perpendicular to the up-down direction 7 and a curved surface 61 which extends frontward from the flat surface 60. The curved surface 61 is a part of the cylindrical surface that extends along the circumferential direction of the axis A34 of the discharge roller 34. The curved surface 58 of the front portion 56 and the curved surface 61 of the rear portion 56 are continuous to each other without no step.

As shown in FIG. 7, the front portion 56 covers a region 63 which is a part of a downstream portion 62 of the discharge roller 34 in the discharge direction 16. Specifically, the downstream portion 62 is a portion of an outer circumferential surface of the discharge roller 34 located frontward of the axis A34, namely, located downstream of the axis A34 in the discharge direction 16. The region 63 is a region in the downstream portion 62 enclosed by: a vertical plane passing the axis A34 of the discharge roller 34; and a plane passing the axis A34 of the discharge roller 34 and a front end 66 of the front portion 56.

A rear end of the curved surface 58 of the front portion 56 is located directly under the lower end 64 and an upper end 65 of the discharge roller 34. The lower end 64 and the upper end 65 of the discharge roller 34 are located within the vertical plane passing the axis A34 of the discharge roller 34. A front end of the curved surface 58 of the front portion 56 and the flat surface 59 are located at a height level higher than the rear end of the curved surface 58 of the front portion 56 and are located between the lower end 64 and the upper end 65 of the discharge roller 34. An imaginary line L64 indicates a straight line passing the lower end 64 and extending in the front-rear direction 8. As shown in FIG. 7, the flat surface 59 may be referred to as a facing surface that faces the outer circumferential surface of the discharge roller 34 located at the nip position (which will be explained) when the cover 41 is located at a first position (which will be explained). When the cover 41 and the discharge roller 34 are viewed in a direction in which the axis A34 of the discharge roller 34 extends in a state in which the cover 41 is located at the first position and the discharge roller 34 is located at the nip position, the flat surface 59 is located downstream of the axis A34 and upstream of a downstream end of the discharge roller 34 in the discharge direction 16, as shown in FIG. 7. Further, the flat surface 59 is located at a height level higher than the lower end 64 of the discharge roller 34.

The front end 66 (as one example of a position of a downstream end in the discharge direction 16) of the front portion 56 is located more rearward (i.e., located more upstream in the discharge direction 16) than a front end 67 (as one example of a position of a downstream end in the discharge direction 16) of the discharge roller 34. An imaginary line L67 indicates a straight line passing the front end 67 of the discharge roller 34 and extending in the up-down direction 7.

As shown in FIGS. 6 and 7, the rear portion 57 has a through-hole 68 (as one example of "opening") extending in the up-down direction 7. The through-hole 68 is formed in the flat surface 60 of the rear portion 57 and is located more rearward (i.e., more upstream in the discharge direction 16) than the lower end 64 of the discharge roller 34.

As shown in FIGS. 6 and 7, the bottom wall 55 partly covers a portion of the outer circumferential surface of the discharge roller 34 that faces downward. As described above, the front end 66 of the bottom wall 55 is located more rearward than the front end 67 of the discharge roller 34. Thus, the bottom wall 55 covers the outer circumferential surface of the discharge roller 34 except a portion in the vicinity of the front end 67 of the discharge roller 34.

Moving Mechanism 90

Figure 8A:
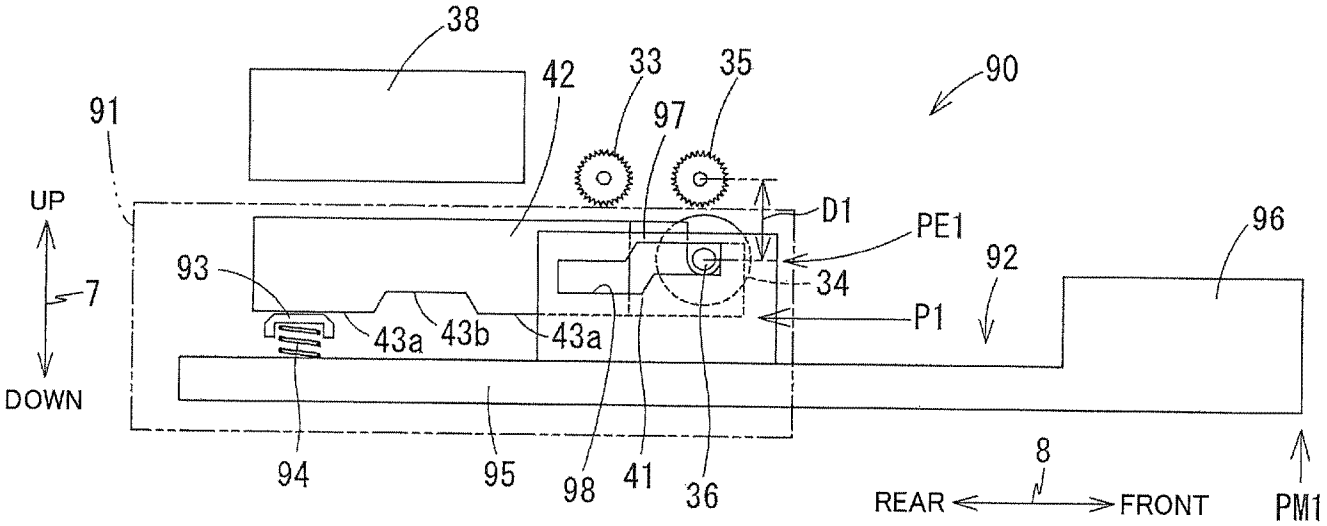
FIG. 8A is an elevational view in vertical cross section schematically showing a moving mechanism according to the first embodiment in a state in which discharge rollers are located at a nip position.
Figure 8B:
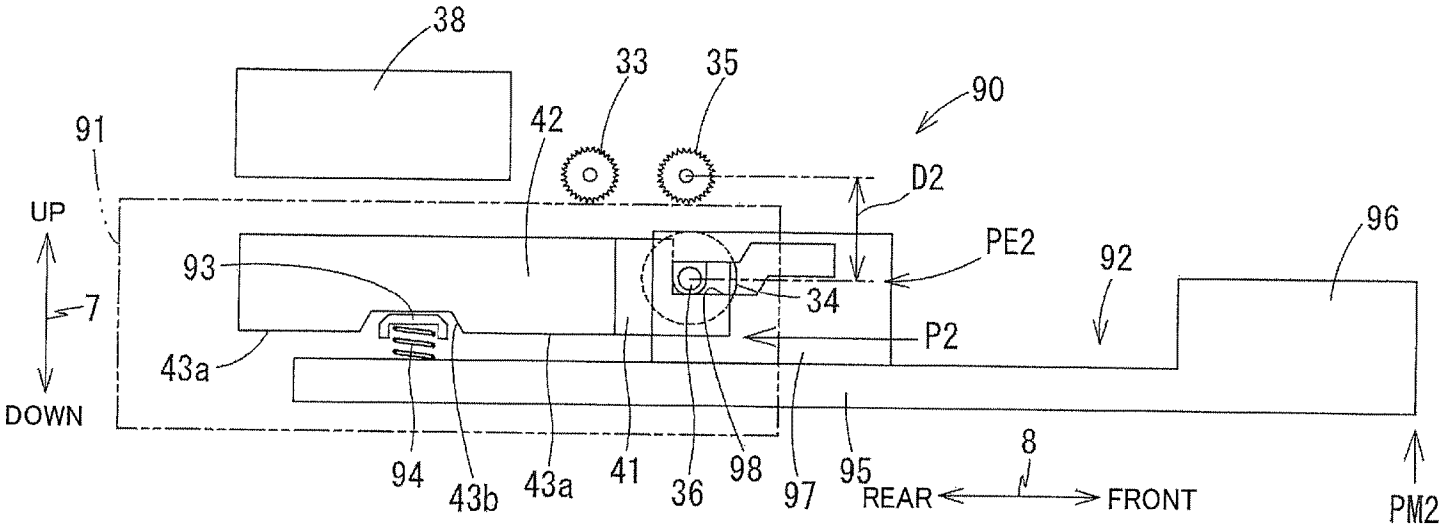
FIG. 8B is an elevational view in vertical cross section schematically showing the moving mechanism according to the first embodiment in a state in which the discharge rollers are located at a separated position.

As shown in FIGS. 8A and 8B, the printer 10 includes a moving mechanism 90 configured to move the discharge rollers 34 and the platen 42. The moving mechanism 90 includes, at each of its opposite end portions in the right-left direction 9, a side frame 91, a movable member 92, a contact member 93, and a spring 94.

The two side frames 91 respectively disposed at the right and left end portions support the platen 42 such that the platen 42 is movable in the up-down direction 7. The two side frames 91 are connected to each other by a frame (not shown) extending in the right-left direction 9. Each side frame 91 supports the corresponding movable member 92 such that the movable member 92 is movable in the front-rear direction 8. The two movable members 92 are connected to each other by a frame (not shown) extending in the right-left direction 9. The following explanation will be made focusing on one movable member 92 where appropriate.

Each movable member 92 includes a long lever portion 95 extending in the front-rear direction 8, a grip portion 96 fixed to a front end of the lever portion 95, and a guide portion 97 fixed to a middle portion of the lever portion 95. The lever portion 95 is supported by the side frame 91 so as to be movable in the front-rear direction 8. The grip portion 96 is disposed over the discharge tray 21 shown in FIG. 1. The guide portion 97 has a guide hole 98 for guiding the rotation shaft 36 of the discharge rollers 34 in the up-down direction 7. The rotation shaft of the discharge rollers 34 passes through the guide hole 98. A front portion (as one example of "first portion) of the guide hole 98 is configured to hold the rotation shaft 36 of the discharge rollers 34 at a higher position in the up-down direction 7 than a position at which a rear portion (as one example of "second portion") of the guide hole 98 holds the roller shaft 36. When a user holds the grip portion 96 and pulls the grip portion 96 forward or pushes the grip portion 96 rearward, the movable member 92 is moved in the front-rear direction 8. The contact member 93 is disposed over a rear end portion of the lever portion 95. The spring 94 is disposed between the contact member 93 and the lever portion 95 and connects the contact member 93 and the lever portion 95. The spring 94 biases the contact member 93 upward with respect to the lever portion 95.

By being guided by the guide hole 98, the discharge roller 34 is movable between the nip position PE1 shown in FIG. 8A and the separated position PE2 shown in FIG. 8B. The nip position PE1 and the separated position PE2 show a position, in the up-down direction 7, of an axis of the rotation shaft 36 of the discharge roller 34. When the discharge roller 34 is located at the nip position PE1, the discharge roller 34 cooperates with the second spur 35 to nip the sheet 12 therebetween and can discharge the sheet 12 in the discharge direction 16. The separated position PE2 is located at a height level lower than the nip position PE1. A distance D2 between an axis of the second spur 35 and the axis of the discharge roller 34 when the discharge roller 34 is located at the separated position PE2 is larger than a distance D1 therebetween when the discharge roller 34 is located at the nip position PE1.

The cover 41 is movable between the first position P1 shown in FIG. 8A and a second position P2 shown in FIG. 8B. The first position P1 and the second position P2 indicate a position, in the up-down direction 7, of a lower end of the cover 41 (i.e., a lower surface of the bottom wall 55). The second position P2 is located at a height level lower than the first position P1.

The movable member 92 is movable between a storage position PM1 shown in FIG. 8A and a protruding position PM2 shown in FIG. 8B. The storage position PM1 and the protruding position PM2 indicate a position of a front end of the grip portion 96 of the movable member 92 in the front-rear direction 8. The protruding position PM2 is located more frontward than the storage position PM1.

When the movable member 92 is located at the storage position PM1 shown in FIG. 8A, the contact member 93 (as one example of "contact portion") biased by the spring 94 is held in contact with the flat portion 43*a* of the platen 42 located rearward of the recessed portion 43*b*. (The flat portion 43*a* of the platen 42 located rearward of the recessed portion 43*b* is one example of "first surface" of the cover 41.) Further, the rotation shaft 36 of the discharge rollers 34 is located at the front portion of the guide hole 98. As described above, the cover 41 is fixed to the platen 42, and the rotation shaft 36 of the discharge rollers 34 is positioned by the guide hole 98 relative to the up-down direction 7. When the movable member 92 is located at the storage position PM1, the discharge roller 34 is located at the nip position PE1 and the cover 41 is located at the first position P1.

The movement of the movable members 92 between the storage position PM1 and the protruding position PM2 causes the platen 42 and the discharge rollers 34 to be moved in the up-down direction 7. As shown in FIG. 8B, when the movable member 92 is located at the protruding position PM2, the contact member 93 biased by the spring 94 is held in contact with the recessed portion 43*b* of the platen 42 (as one example of "second surface" of the cover 41). The recessed portion 43*b* is recessed upward, namely, the recessed portion 43*b* is located at a height level higher than the flat portion 43*a*. Accordingly, the contact member 93 is located at a height level higher than that shown in FIG. 8A whereas the platen 42 is located at a height level lower than that shown in FIG. 8A. Further, the rotation shaft 36 of the discharge rollers 34 is located at the rear portion of the guide hole 98 (as one example of "second portion of the guide hole"). The rear portion of the guide hole 98 is located at a height level lower than the front portion of the guide hole 98. Thus, the axis of the rotation shaft 36 when the rotation shaft 36 is located at the rear portion of the guide hole 98 is located at a height level lower than that when the rotation shaft 36 is located at the front portion of the guide hole 98. Accordingly, the discharge roller 34 is located at the separated position PE2 whose height level is lower than that of the nip position PE1 in the up-down direction 7. Further, the cover 41 is located at the second position P2 whose height level is lower than that of the first position P1 in the up-down direction 7.

The platen 42 is supported by the two side frames 91 so as to be unrotatable about the right-left direction 9 and so as to be movable in the up-down direction 7. With this configuration, in accordance with a change of the position of the movable members 92 between the storage position PM1 and the protruding position PM2, the platen 42 is translated in the up-down direction 7. Since the cover 41 is fixed to the platen 42 and the discharge rollers 34 are supported by the cover 41, the translation of the platen 42 causes the cover 41 and the discharge rollers 34 to be translated.

Advantageous Effects of First Embodiment

According to the printer 10 of the first embodiment, the discharge rollers 34 are moved to the separated position PE2, and the cover 41 is moved to the second position P2. With this configuration, the cover 41 does not disturb the jam clearing operation to take out the sheet 12 present between the second spurs 35 and the discharge rollers 34.

When the cover 41 is located at the first position P1, a region of the downstream portion 62 of each discharge roller 34 in the discharge direction 16 except the region 63 is exposed, namely, is not covered by the cover 41, enabling the sheet 12 to easily pass without being disturbed by the cover 41.

The positional relationship between the discharge rollers 34 and the cover 41 is maintained, so that a distance over which the cover 41 moves is minimized while a collision of the cover 41 and the discharge rollers 34 is avoided.

The first embodiment easily attains the structure for moving the cover 41 in conjunction with the movement of the discharge rollers 34.

In the first embodiment, the cover 41 does not protrude in the discharge direction beyond the discharge rollers 34, so that the cover 41 does not disturb the sheet 12 to be discharged by the discharge rollers 34, enabling the sheet 12 to easily pass.

The cover 41 includes the side walls 54, thereby preventing the discharge rollers 34 from being touched by the user in the axial direction.

The cover 41 includes the bottom walls 55, thereby preventing the discharge rollers 34 from being touched by the user from below. Further, paper dust of the sheet 12 is received by the bottom walls 55, thereby preventing dropping of paper dust.

Each bottom wall 55 has the through-hole 68. It is consequently possible to prevent paper dust from being accumulated on the bottom wall 55 to such an extent that paper dust disturbs rotation of the discharge roller 34.

As compared with a case in which the cover 41 is formed separately from the platen 42, the cover 41 is easily formed.

Second Embodiment

Figure 9A:
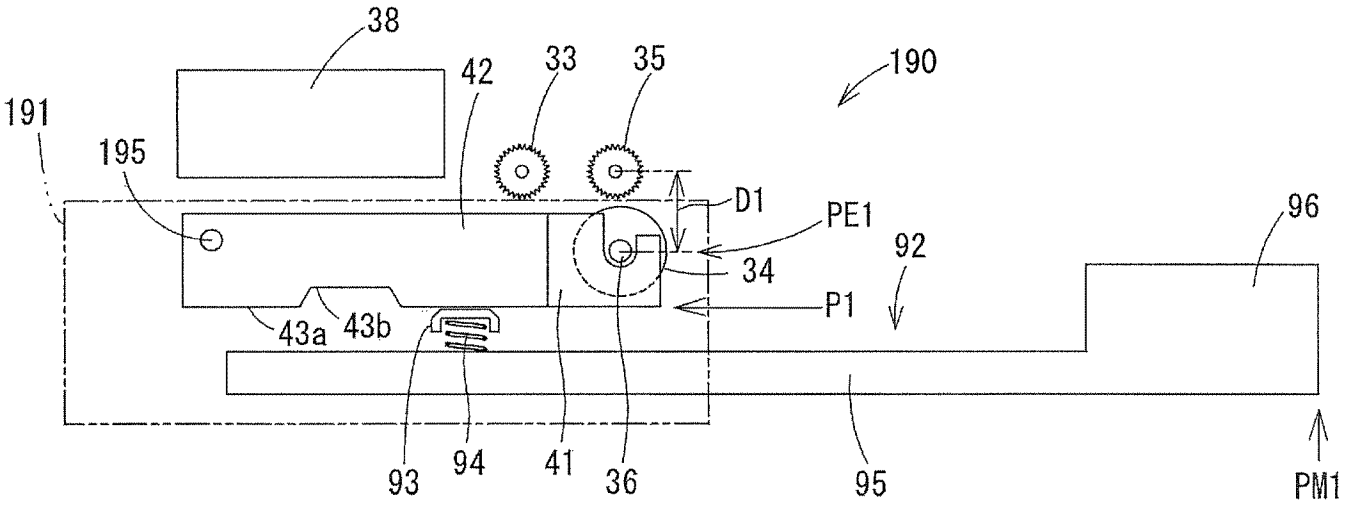
FIG. 9A is an elevational view in vertical cross section schematically showing a moving mechanism according to a second embodiment in a state in which the discharge rollers are located at the nip position.
Figure 9B:
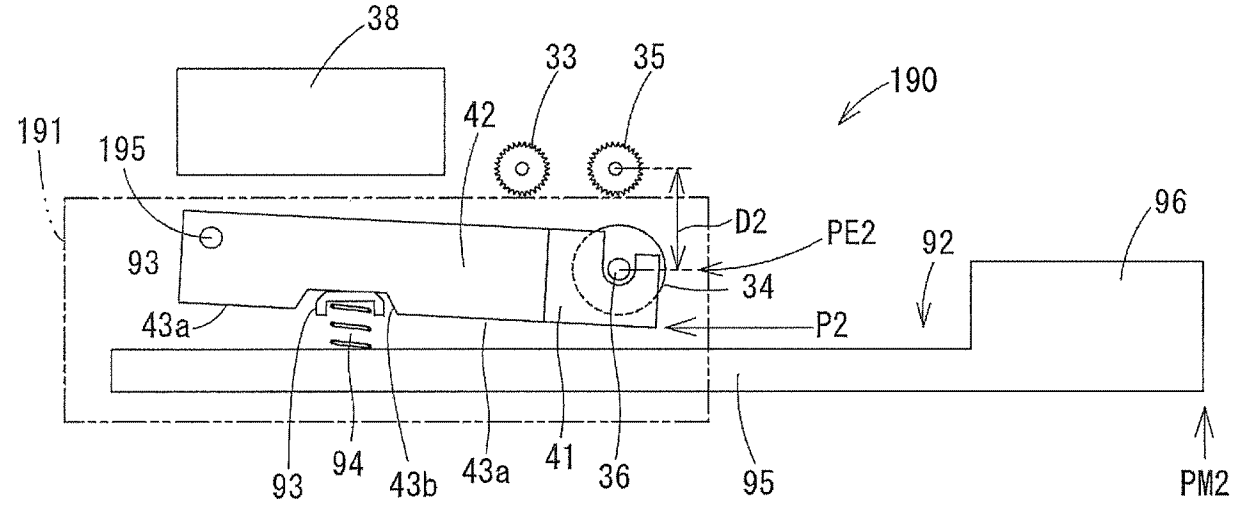
FIG. 9B is an elevational view in vertical cross section schematically showing the moving mechanism according to the second embodiment in a state in which the discharge rollers are located at the separated position.

Referring next to FIGS. 9A and 9B, there will be explained a moving mechanism 190 of the printer 10 according to a second embodiment. The moving mechanism 190 of the second embodiment causes the platen 42 to be rotated about a shaft extending in the right-left direction 9, instead of causing the platen 42 to be translated. The configuration of the second embodiment is similar to that of the first embodiment except the structure of the moving mechanism 190, and a detailed explanation is dispensed with.

As shown in FIGS. 9A and 9B, the moving mechanism 190 includes two side frames 191, a supporting shaft 195, the two movable members 92, the two contact members 93, and the two springs 94. The side frames 191, the movable members 92, the contact members 93, and the springs 94 are respectively provided at right and left end portions of the moving mechanism 190 in the right-left direction 9.

Each movable member 92 is movable between a storage position PM1 shown in FIG. 9A and a protruding position PM2 shown in FIG. 9B. The storage position PM1 and the protruding position PM2 is a position of the front end of the grip portion 96 of the movable member 92 in the front-rear direction 8. In the second embodiment, the protruding position PM2 is located more rearward than the storage position PM1. Thus, the protruding position PM1 may be referred to as a front position, and the storage position PM2 may be referred to as a rear position.

The two side frames 191 respectively located at the right and left end portions support the platen 42 through the supporting shaft 195. The supporting shaft 195 is the shaft extending in the right-left direction 9 and fixed to the two side frames 191. The platen 42 is rotatable about the supporting shaft 195. The two side frames 191 are connected by a frame (not shown) extending in the right-left direction 9. Each side frame 191 supports the corresponding movable member 92 such that the movable member 92 is movable in the front-rear direction 8.

When the movable member 92 is located at the storage position PM1 shown in FIG. 9A, the contact member 93 biased by the spring 94 is held in contact with the flat portion 43*a* of the platen 42 located frontward of the recessed portion 43*b*. (The flat portion 43*a* of the platen located frontward of the recessed portion 43*b* is one example of "first surface" of the cover 41). When the contact member 93 is held in contact with the flat portion 43*a* of the platen 42, the discharge roller 34 is located at the nip position PE1 and the cover 41 is located at the first position P1.

As shown in FIG. 9B, when the movable member 92 is located at the protruding position PM2, the contact member 93 biased by the spring 94 is held in contact with the recessed portion 43*b* of the platen 42 (as one example of "second surface" of the cover 41). Because the recessed portion 43*b* is recessed upward, the contact member 93 is located at a height level higher than that in FIG. 9A whereas the front end portion of the platen 42 is located at a height level lower than that in FIG. 9A. That is, the platen 42 is inclined in a forward-and-downward direction. When the contact member 93 is held in contact with the recessed portion 43*b* of the platen 42, the discharge roller 34 is located at the separated position PE2 and the cover 41 is located at the second position P2.

The platen 42 is supported by the two side frames 191 so as to be rotatable about the right-left direction 9. With this configuration, when the position of the movable member 92 changes between the storage position PM1 and the protruding position PM2, the platen 42 pivots about the supporting shaft 195. Since the cover 41 is fixed to the platen 42 and the discharge rollers 34 are supported by the cover 41, the pivotal movement of the platen 42 causes the cover 41 and the discharge rollers 34 to pivot about the pivot shaft 195.

Modifications

In the printer 10 according to the first and second embodiments, the uppermost position of the front portion 56 of the bottom wall 55 (i.e., the front end of the curved surface 58 and the flat surface 59) is located between the lower end 64 and the upper end 65 of the discharge roller 34. Further, the bottom wall 55 partially covers a frontward facing portion of the outer circumferential surface of the discharge roller 34. It is needed for the bottom wall 55 to cover at least partially the outer circumferential surface of the discharge roller 34, and the entirety of the frontward facing portion of the outer circumferential surface of the discharge roller 34 need not be covered at all by the bottom wall 55. A front wall that extends upward from the front end of the bottom wall 55 may be provided as long as the sheet 12 easily passes the discharge rollers 34 without being adversely influenced by the provision of the front wall. The front wall may cover a portion of the discharge roller 34 ranging from the lower end 64 of the discharge roller 34 to the front end 67 thereof. Further, the front wall may cover a portion of the discharge roller 34 ranging from the lower end 64 of the discharge roller 34 to the vicinity of the upper end 65 thereof.

In the printer 10 according to the first and second embodiments, the discharge rollers 34 are supported by the cover 41 fixed to the platen 42, and the movable members 92 cause the discharge rollers 34 and the cover 41 to move together in conjunction with the movement of the platen 42 while the distance between the cover 41 and the axis of the discharge rollers 34 is kept constant. The configuration of the movable member 92 is not limited to those in the first embodiment and the second embodiment as long as the movable member 92 causes the cover 41 to be moved from the first position P1 to the second position P2 in conjunction with the movement of the discharge rollers 34 from the nip position PE1 to the separated position PE2. The movable members 92 may be connected to the discharge rollers 34 and the cover 41 through individual link mechanisms. In a case where the movable member 92 is configured to move the discharge rollers 34 and the cover 41 independently of each other, the distance between the cover 41 and the axis of the discharge rollers 34 is not necessarily required to be kept constant.

In the printer 10 according to the first and second embodiments, the engaging portions 50 of the cover 41 are held in engagement with the rotation shaft 36 of the discharge rollers 34. The cover 41 does not necessarily have to be held in engagement with the rotation shaft 36 of the discharge rollers 34.

In the printer 10 according to the first and second embodiments, the front end 66 of the bottom wall 55 is located more rearward than the front end 67 of the discharge roller 34. The front end 66 of the bottom wall 55 may be located more frontward than the front end 67 of the discharge roller 34.

In the printer 10 according to the first and second embodiments, the bottom wall 55 has the through-hole 68. The bottom wall 55 may have an opening portion that opens upward, instead of the through-hole 68. The through-hole 68 may be omitted.

In the printer 10 according to the first and second embodiments, the cover 41 is integral with the platen 42. The platen 42 and the cover 41 may be separate from each other.

In the printer 10 according to the first and second embodiments, the movable members 92 are manually moved by the user. The movable members 92 may be moved by driving of a motor. In this case, the printer 10 includes a drive-force transmitting mechanism for transmitting a rotation driving force of the motor to the movable members 92.

In the printer 10 according to the first and second embodiments, the movable member 92 is a sliding member reciprocable in the front-rear direction 8. The movable member 92 may be an eccentric cam. In this case, the lower surface of a member that supports the discharge rollers 34 and the cover 41 (e.g., the platen 42) is configured to be in contact with an outer circumferential surface of the eccentric cam. In accordance with rotation of the eccentric cam, a position of an upper end of the outer circumferential surface of the eccentric cam changes up and down, whereby the discharge rollers 34 and the cover 41 are moved in the up-down direction 7.

What is claimed is:

1. A conveyor device, comprising:

a first roller;

a second roller disposed under the first roller and configured to be movable between a nip position at which the second roller cooperates with the first roller to nip a sheet therebetween so as to discharge the sheet in a discharge direction and a separated position located at a height level lower than the nip position;

a cover configured to be movable between a first position and a second position located at a height level lower than the first position, the cover including a downstream wall which at least partially covers a downstream portion of the second roller located at the nip position when the cover is located at the first position; and a moving mechanism configured to move the second roller between the nip position and the separated position and to move the cover between the first position and the second position, wherein a position of a downstream end of the downstream wall of the cover in the discharge direction is located upstream, in the discharge direction, of a position of a downstream end of the downstream portion of the second roller in the discharge direction, wherein the downstream wall of the cover includes a facing surface that faces the second roller when the cover is located at the first position, and wherein the facing surface is located downstream of an axis of the second roller and upstream of a downstream end of the second roller when viewed in a direction in which the axis extends and is located at a height level higher than a lower end of the second roller, in a state in which the second roller is located at the nip position.

2. The conveyor device according to claim 1, wherein the downstream portion of the second roller is a portion of the second roller located downstream of an axis of the second roller in the discharge direction when viewed in a direction in which the axis extends.

3. The conveyor device according to claim 1, wherein the downstream wall of the cover extends, on a downstream side of a lower end of the second roller in the discharge direction, upward from a position whose height level is lower than that of the lower end of the second roller to a position between the lower end and an upper end of the second roller.

4. The conveyor device according to claim 1, wherein the moving mechanism is configured to move the cover from the first position to the second position in conjunction with a movement of the second roller from the nip position to the separated position while a distance between the cover and the axis of the second roller is kept constant.

5. The conveyor device according to claim 1, wherein the cover includes an engaging portion engaged with a roller shaft of the second roller.

6. The conveyor device according to claim 1, wherein the cover includes a side wall which at least partially covers an end face of the second roller in its axial direction which is located at the nip position when the cover is located at the first position.

7. The conveyor device according to claim 1, wherein the cover includes a lower wall which at least partially covers a downwardly facing portion of an outer circumferential surface of the second roller which is located at the nip position when the cover is located at the first position.

8. The conveyor device according to claim 7, wherein the lower wall has an opening disposed upstream of a lower end of the second roller in the discharge direction.

9. The conveyor device according to claim 1, wherein the cover is engaged with a roller shaft of the second roller, wherein the moving mechanism has a guide hole for guiding the roller shaft, the guide hole including a first portion and a second portion whose height level is lower than the first portion, wherein, when the roller shaft is located at the first portion of the guide hole, the moving mechanism causes the cover to be located at the first position and causes the second roller to be located at the nip position, and wherein, when the roller shaft is located at the second portion of the guide hole, the moving mechanism causes the cover to be located at the second position and causes the second roller to be located at the separated position.

10. The conveyor device according to claim 1, wherein the cover is engaged with a roller shaft of the second roller, wherein the cover includes a first surface and a second surface whose height level is higher than the first surface, wherein the moving mechanism includes a contact portion, wherein the moving mechanism causes the cover to be located at the first position and causes the second roller to be located at the nip position when the contact portion is held in contact with the first surface of the cover from below, and wherein the moving mechanism causes the cover to be located at the second position and causes the second roller to be located at the separated position when the contact portion is held in contact with the second surface of the cover from below.

11. The conveying device according to claim 1, wherein a plurality of second rollers, each as the second roller, are arranged and spaced apart from each other in a widthwise direction that is perpendicular to the discharge direction, and wherein a plurality of covers, each as the cover, are respectively provided for the plurality of second rollers.

12. A conveyor device, comprising:

a first roller;

a second roller disposed under the first roller and configured to be movable between a nip position at which the second roller cooperates with the first roller to nip a sheet therebetween so as to discharge the sheet in a discharge direction and a separated position located at a height level lower than the nip position;

a cover configured to be moveable between a first position and a second position located at a height level lower than the first position, the cover including a downstream wall which at least partially covers a downstream portion of the second roller located at the nip position when the cover is located at the first position; and a moving mechanism configured to move the second roller between the nip position and the separated position and to move the cover between the first position and the second position, wherein the cover includes a lower wall which at least partially covers a downwardly facing portion of an outer circumferential surface of the second roller which is located at the nip position when the cover is located at the first position, and wherein the lower wall has an opening disposed upstream of a lower end of the second roller in the discharge direction.

13. A conveyor device, comprising:

a first roller;

a second roller disposed under the first roller and configured to be movable between a nip position at which the second roller cooperates with the first roller to nip a sheet therebetween so as to discharge the sheet in a discharge direction and a separated position located at a height level lower than the nip position;

a cover configured to be movable between a first position and a second position located at a height level lower than the first position, the cover including a downstream well which at least partially covers a downstream portion of the second roller located at the nip position when the cover is located at the first position, and a moving mechanism configured to move the second roller between the nip position and the separated position and to move the cover between the first position and the second position, wherein the cover is engaged with a roller shaft of the second roller, wherein the moving mechanism has a guide hole for guiding the roller shaft, the guide hole including a first portion and a second portion whose height level is lower than the first portion, wherein, when the roller shaft is located at the first portion of the guide hole, the moving mechanism causes the cover to be located at the first position and causes the second roller to be located at the nip position, and wherein, when the roller shaft is located at the second portion of the guide hole, the moving mechanism causes the cover to be located at the second position and causes the second roller to be located at the separated position.

14. A conveyor device, comprising:

a first roller;

a second roller disposed under the first roller and configured to be movable between a nip position at which the second roller cooperates with the first roller to nip a sheet therebetween so as to discharge the sheet in a discharge direction and a separated position located at a height level lower than the nip position;

a cover configured to be movable between a first position and a second position located at a height level lower than the first position, the cover including a downstream wall which at least partially covers a downstream portion of the second roller located at the nip position when the cover is located at the first position; and a moving mechanism configured to move the second roller between the nip position and the separated position and to move the cover between the first position and the second position, wherein a position of a downstream end of the downstream wall of the cover in the discharge direction is located upstream, in the discharge direction, of a position of a downstream end of the downstream portion of the second roller in the discharge direction, and wherein the downstream wall of the cover extends, on a downstream side of a lower end of the second roller in the discharge direction, upward from a position whose height level is lower than that of the lower end of the second roller to a position between the lower end and an upper end of the second roller.

* * * * *